United States Patent [19]

Yoshida et al.

[11] Patent Number: 4,543,805

[45] Date of Patent: Oct. 1, 1985

[54] METHOD OF ATTACHING A SEPARABLE SLIDE FASTENER TO KNIT FABRICS

[75] Inventors: Hiroshi Yoshida, Kurobe; Yoshio Matsuda, Toyama; Shunji Akashi, Kurobe, all of Japan

[73] Assignee: Yoshida Kogyo K.K., Tokyo, Japan

[21] Appl. No.: 420,893

[22] Filed: Sep. 21, 1982

Related U.S. Application Data

[62] Division of Ser. No. 258,647, Apr. 29, 1981.

[30] Foreign Application Priority Data

Jul. 12, 1980 [JP] Japan ..... 55-95240

[51] Int. Cl.[4] ..... D04B 9/40

[52] U.S. Cl. ..... 66/148; 66/193; 66/190; 112/25

[58] Field of Search ..... 66/192, 193, 195, 148; 112/25, 27

[56] References Cited

U.S. PATENT DOCUMENTS

| | | | |
|---|---|---|---|
| 2,563,194 | 8/1950 | Kaplan | 112/25 |
| 2,701,222 | 2/1955 | Hetzel et al. | 154/116 |
| 3,563,194 | 2/1971 | Conti | 112/25 |
| 3,881,326 | 5/1975 | Bourgeois | 66/195 |
| 4,419,868 | 12/1983 | Matsuda | 66/195 |
| 4,442,685 | 4/1984 | Matsuda | 66/195 |

FOREIGN PATENT DOCUMENTS

| | | | |
|---|---|---|---|
| 827367 | 11/1969 | Canada | 24/47 |
| 34-6608 | 3/1959 | Japan . | |
| 50-84205 | 7/1975 | Japan . | |
| 51-135709 | 2/1976 | Japan . | |
| 52-24161 | 1/1977 | Japan . | |

*Primary Examiner*—Ronald Feldbaum

*Attorney, Agent, or Firm*—Hill, Van Santen, Steadman & Simpson

[57] ABSTRACT

A separable slide fastener to be attached to a knit fabric has a pair of warp-knit stringer tapes each with a series of openings. Each of the stringer tapes may include a reinforcement film bonded to a lower end portion thereof and having a recess which allows some of the tape openings to be exposed for use in attachment to the knit fabric. The recess may be covered with a thin layer penetratable by knitting needles. A separble bottom end stop may be injection-molded on the reinforcement films bonded to the stringer tapes. Knitting needles are inserted in the openings, and a fabric is knitted thereon to form successive courses. To this end, a row of loops of a course are looped with transverse longitudinally spaced thread portions which define ends of the openings.

7 Claims, 31 Drawing Figures

METHOD OF ATTACHING A SEPARABLE SLIDE FASTENER TO KNIT FABRICS

This is a division of application Ser. No. 258,647, filed Apr. 29, 1981.

BACKGROUND OF THE INVENTION

1. Field of the Invention

The present invention relates to a method of attaching a separable slide fastener to knit fabrics.

2. Prior Art

A variety of slide fasteners are known which have coarse regions or openings in stringer tapes thereof for venting air or easy attachment to bags or articles of different materials. Some representative prior art slide fasteners are disclosed in the following patents and publications:

U.S. Pat. No. 2,701,222, patented Feb. 1, 1955;

Canadian Pat. No. 827,367, patented Nov. 18, 1969;

Japanese Utility Model Publication No. 34-6608, published May 4, 1959;

Japanese Utility Model Publication No. 52-24161 published June 1, 1977;

Japanese Utility Model Laid-Open Publication No. 50-84205, published July 18, 1975; and Japanese Utility Model Laid-Open Publication No. 51-135709 published Nov. 2, 1976.

SUMMARY OF THE INVENTION

A separable slide fastener has a pair of warp-knit stringer tapes each including a first web, a second web, and a connector thread interconnecting confronting wales in the first and second webs laterally together with a coarse wale-free region therebetween. To attach the fastener to a knit fabric, knitting needles are inserted in openings between transverse connector thread portions, and the fabric is knit thereon to form successive courses. A row of loops of a course are looped with the transverse connector thread portions.

It is an object of the present invention to provide a method of attaching a separable slide fastener to a knit fabric without the article becoming puckered or wavy.

Another object of the present invention is to provide a method of attaching a separable slide fastener to a knit fabric, the resulting article being relatively free from being adversely affected by the stretching of the knit fabric.

Still another object of the present invention is to provide a method of attaching a separable slide fastener to a knit fabric, such that the separable bottom end stop of the article can be coupled and uncoupled smoothly.

Still another object of the present invention is to provide a method of attaching a separable slide fastener to a knit fabric, the fastener having in its stringer tapes coarse regions along which the slide fastener is attachable, the resulting articles being reinforced at ends for protection against being torn under frequent stresses due to repeated coupling and uncoupling of a separable bottom end stop on the stringer tapes.

Still another object of the present invention is to provide a method of knitting a separable slide fastener into a knit fabric while the latter is being knitted.

Still another object of the present invention is to provide a method of attaching a separable slide fastener to a knit fabric easily on a knitting machine.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
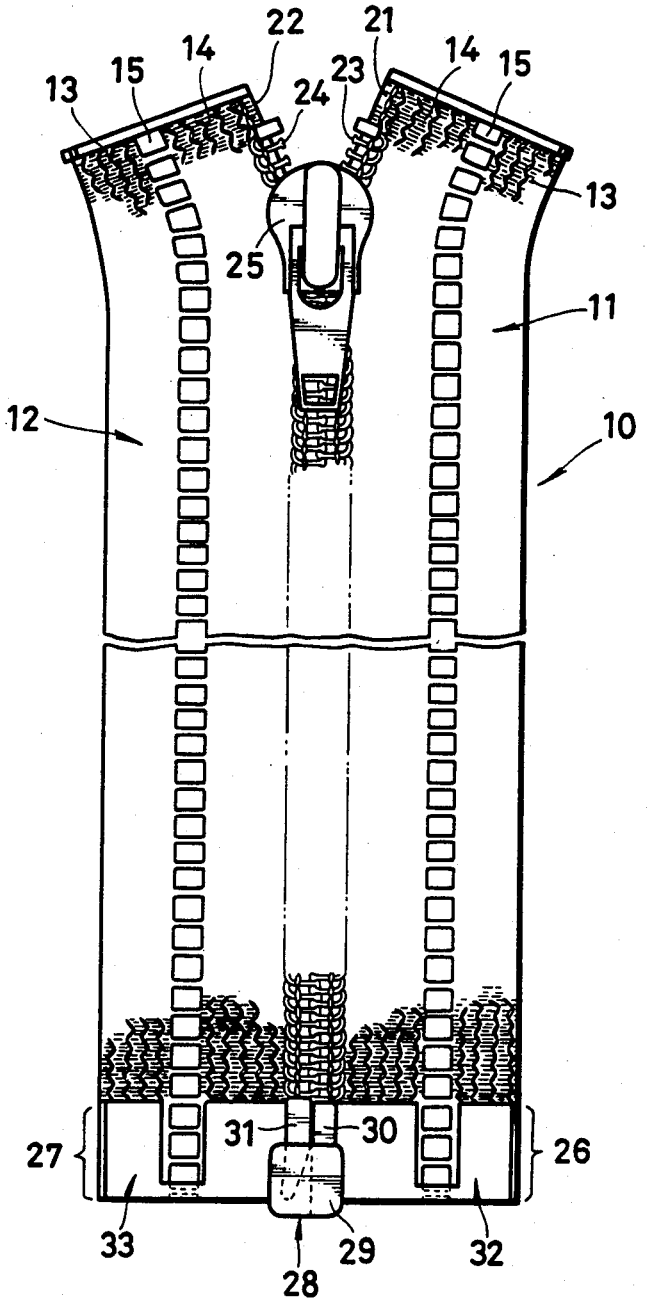
FIG. 1 is a fragmentary plan view of a separable slide fastener which is attachable to knit fabric according to the present invention.
Figure 2:
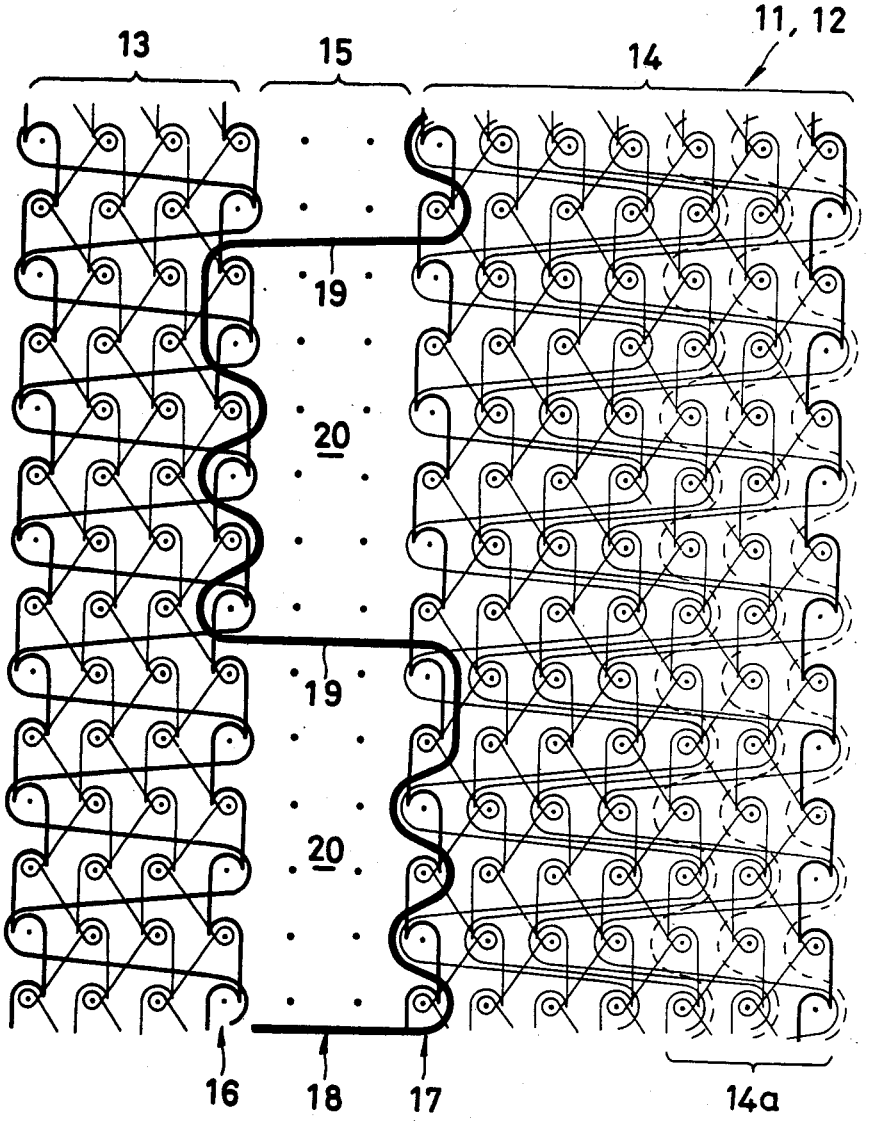
FIG. 2 is a point diagram showing lapping movements for a warp-knit stringer tape of the slide fastener shown in FIG. 1.
Figure 3:
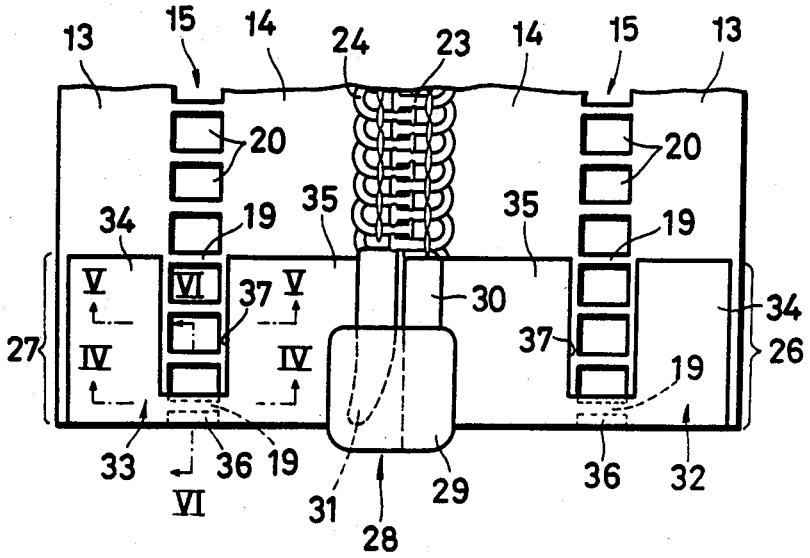
FIG. 3 is an enlarged fragmentary plan view of a lower end portion of the slide fastener shown in FIG. 1.
Figure 6:
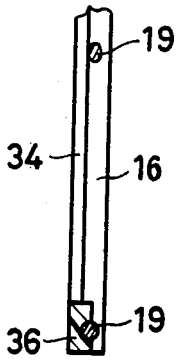
FIG. 6 is an enlarged cross-sectional view taken along line VI—VI of FIG. 3.
Figure 4:
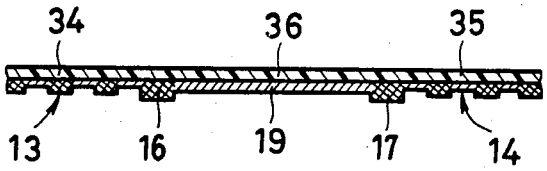
FIG. 4 is an enlarged cross-sectional view taken along line IV—IV of FIG. 3.
Figure 5:
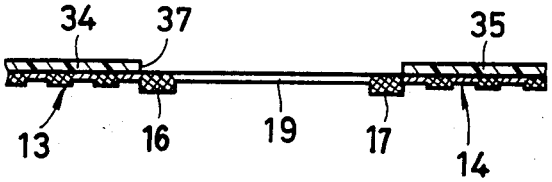
FIG. 5 is an enlarged cross-sectional view taken along line V—V of FIG. 3.

As shown in FIG. 1, a separable slide fastener 10 for use on a garment such as a cardigan sweater having completely separable opposite edges along which the fastener is attachable, comprises a pair of warp-knit stringer tapes 11,12 each including a pair of first and second longitudinal warp-knit webs 13,14 with a wale-free coarse region 15 therebetween which is devoid of two wales (FIG. 2). The wale-free coarse region 15, however, may be varied in width by selecting a suitable number of wales to be omitted therefrom. As best shown in FIG. 2, the webs 13,14 have a pair of innermost opposite wales 16,17, respectively, which include chain stitches of reinforced yarn and are interconnected by a connector thread 18 laid in a pattern of 0-0/1-1/0-0/1-1/0-0/0-0/4-4/3-3/4-4/3-3/4-4/4-4. The connector thread 18 thus laid in includes a plurality of substantially parallel portions 19 extending transversely across the wale-free coarse region 15, providing a plurality of rectangular openings 20 arranged longitudinally in and along the wale-free coarse region 15. The connector thread 18 is made of a plurality of foundation threads twisted together. The second webs 14,14 (FIG. 1) have a pair of beaded edges 21,22, respectively, each of which is constructed of a reinforced region 14*a* (FIG. 2) of the web 14. A pair of rows of coupling elements 23,24, which are made preferably of filamentary material, is mounted on the beaded edges 21,22, respectively, of the webs 14,14. A slider 25 (FIG. 1) is slidably mounted on the rows of coupling elements 23,24 for taking the latter into and out of interdigitating engagement to open and close the slide fastener 10.

The stringer tapes 11,12 have respective lower end portions 26,27 on which is mounted a separable bottom end stop 28 including a box 29 and a box pin 30 extending therefrom, the box 29 and the box pin 30 being injection-molded on the end portion 26 of the tape 12, and a pin 31 injection-molded on the end portion 27 of the tape 12. The separable bottom end stop 28 is located adjacent to the lower end of the rows of coupling elements 23,24. The first web 13 is narrower than the second web 14.

As best illustrated in FIGS. 3 through 6, a pair of reinforcement members 32,33 each in the form of a film is bonded to or otherwise mounted on the tape end portions 26,27, respectively, each of the reinforcement members 32,33 including first and second portions 34,35 disposed on the webs 14,13, respectively, and a third portion 36 contiguous to and joining the first and second portions 34,35 and extending across the wale-free coarse region 15 in overlying relation to the lowermost one of the parallel portions 19 of the connector thread 18. The third portion 36 is of such a width that there is defined a recess 37 between the first and second portions 34,35 and through which the wale-free coarse region 15 is exposed. The reinforcement members 32,33 are integrally connected to the box 29 and box pin 30 and the pin 31, respectively.

Preferably, the reinforcement films 32,33 are first attached, and then the separable bottom end stop 28 is injection-molded integrally with the films 32,33.

With the reinforcement members 32,33 thus mounted on the tapes 11,12, respectively, the pin 31 can be manipulated smoothly into and out of fitting engagement with the box 29, and the tapes 11,12 are protected against rupture at the coarse regions 15,15 which would otherwise occur due to repeated coupling and uncoupling of the separable end stop 28.

Figure 7:
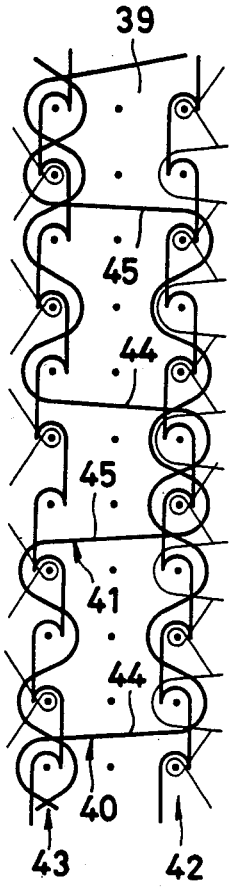
FIG. 7 is a point diagram showing lapping movements for a portion of a modified stringer tape.

FIG. 7 shows a modification in which a pair of connector threads 40,41 is laid across a wale-free region 39 in patterns of 0-0/1-1/0-0/1-1/0-0/3-3/2-2/3-3/2-2/3-3 and 3-3/2-2/3-3/0-0/1-1/0-0/1-1/0-0/3-3/2-2, respectively, the connector threads 40,41 interconnecting a pair of innermost opposite wales 42,43 of a pair of warp-knit webs (not shown). The connector threads 40,41 have transverse portions 44,45, respectively, extending across the wale-free region 39.

Figure 8:
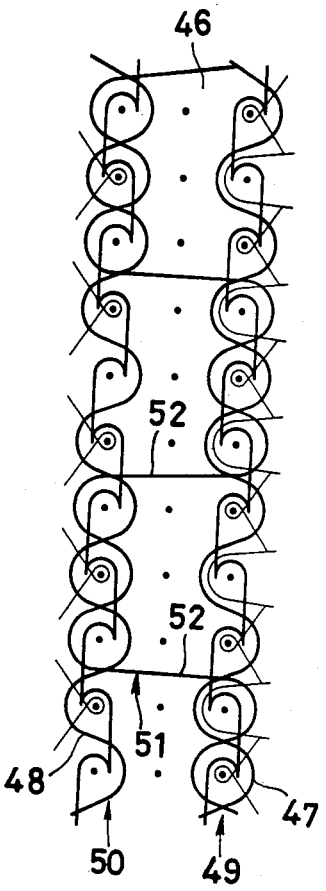
FIG. 8 is a point diagram showing lapping movements for a portion of a modified stringer tape.

According to another modification shown in FIG. 8, a pair of warp threads 47,48 is laid along a pair of innermost opposite wales 49,50, respectively, each in a pattern of 0-0/1-1. A connector thread 51 is laid in a pattern of 0-0/1-1/0-0/3-3/2-2/3-3 across a wale-free region 46 with transverse portions 52 extending between the wales 49,50.

Figure 9:
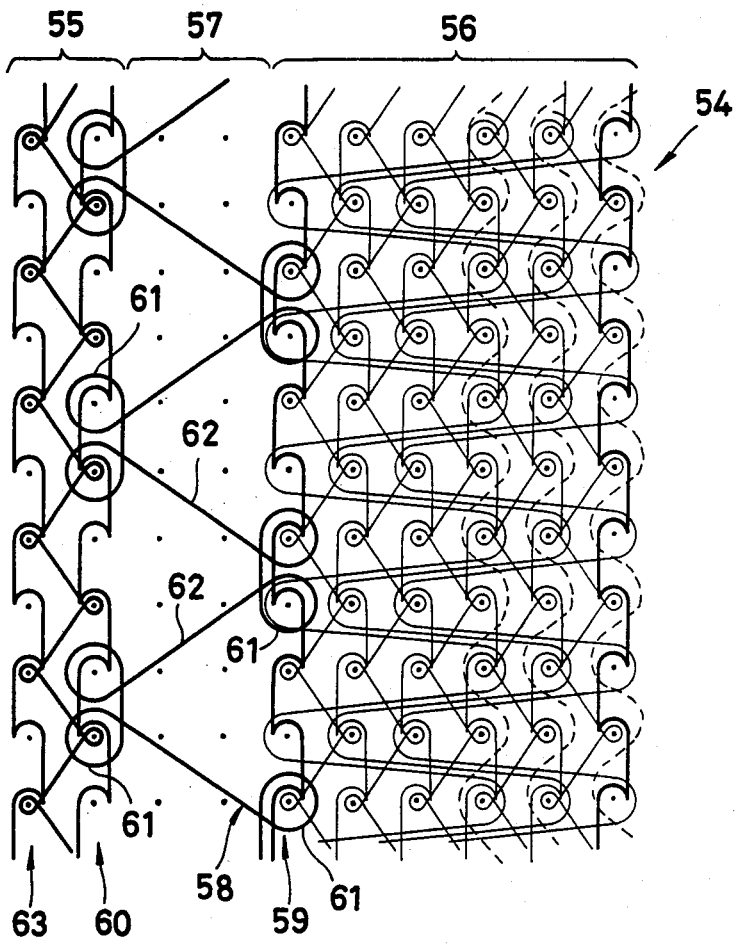
FIG. 9 is a point diagram showing lapping movements for a modified stringer tape.

FIG. 9 illustrates a modified stringer tape 54 including a first warp-knit web 55, a second warp-knit web 56 spaced laterally therefrom with a wale-free coarse region 57 therebetween, and a connecting thread 58 knitted in a pattern of 1-0/3-4/3-4/1-0 across the wale-free region 57. The connector thread 58 has stitches or loops 61 incorporated in a pair of innermost opposite wales 60,59 of the first and second webs 55,56, respectively, and transverse portions 62 extending obliquely across the wale-free region 57. The first warp-knit web 55 is composed of the wale 60 and an additional wale 63 adjacent thereto and remote from the wale-free region 57.

Figure 10:
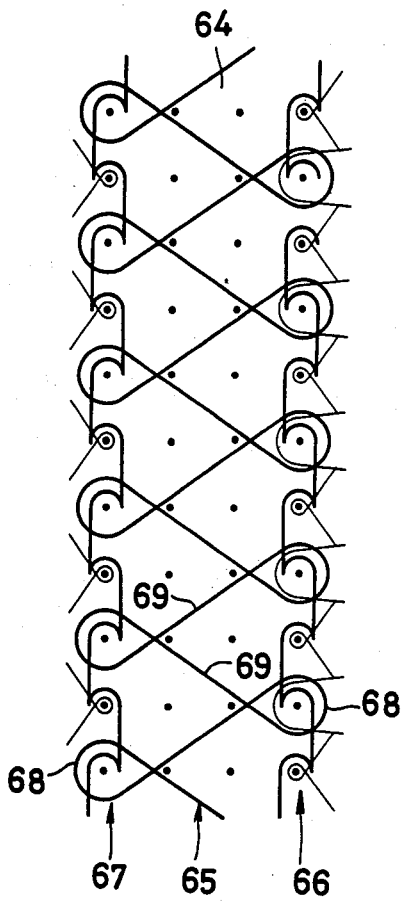
FIG. 10 is a point diagram showing lapping movements for a portion of a modified stringer tape.

Another modification shown in FIG. 10 comprises a connector thread 65 knitted in a pattern of 3-4/1-0 between a pair of innermost opposite wales 66,67 of a pair of warp-knit webs (not shown), the connector thread 65 having stitches or loops 68 incorporated in the wales 66,67. The connector thread 65 also has transverse portions 69 extending obliquely across a wale-free region 64 between the innermost opposite wales 66,67.

Figure 11:
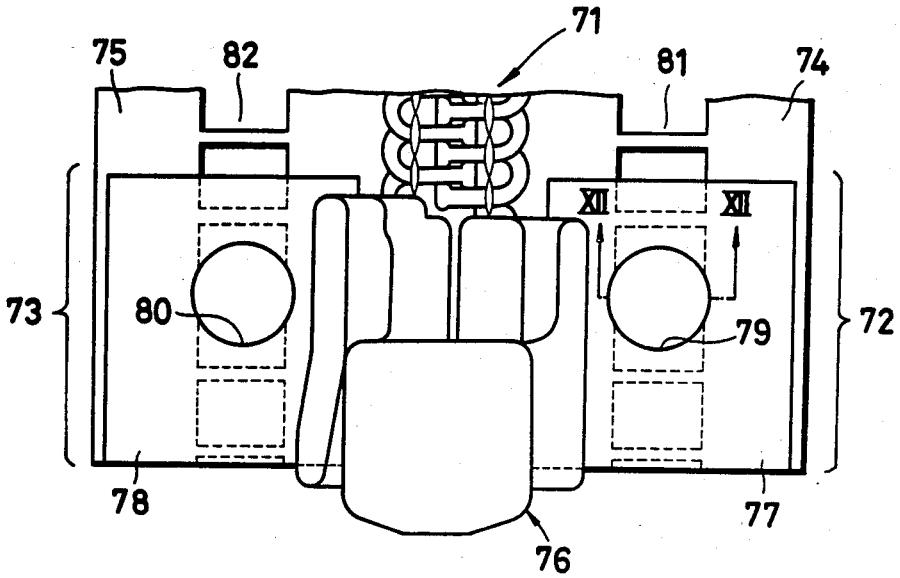
FIG. 11 is an enlarged fragmentary plan view of a lower end portion of a modified separable slide fastener.
Figure 12:
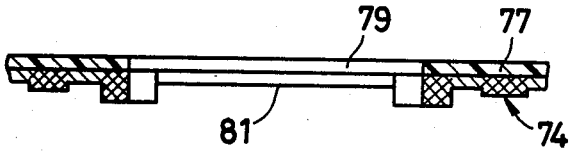
FIG. 12 is an enlarged cross-sectional view taken along line XII—XII of FIG. 11.

FIGS. 11 and 12 illustrate a modified separable slide fastener 71 which includes a pair of lower end portions 72,73 of warp-knit stringer tapes 74,75, respectively, on which a separable bottom end stop 76 is mounted. A pair of reinforcement members 77,78 in the form of films of a uniform thickness is bonded to the tape end portions 72,73, respectively. The reinforcement films 77,78 have a pair of holes 79,80, respectively, which are substantially registered with wale-free coarse regions 81,82 respectively in the tapes 74,75. Such holes 79,80 can be formed as by punching after the films 77,78 have been bonded to the stringer tapes 74,75.

Figure 13:
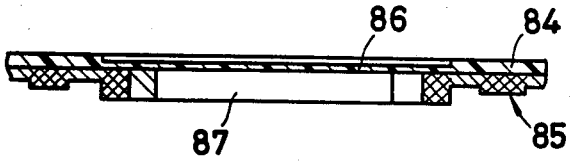
FIG. 13 is a view similar to FIG. 12, showing a modification.

FIG. 13 shows a modified reinforcement film 84 bonded to a warp-knit stringer tape 85 and including a thin layer 86 overlying a wale-free coarse region 87, the thin layer 86 of the film 84 being of a reduced thickness such that it is readily penetratable by a knitting needle when the latter is thrust in, as described later on.

Figure 14:
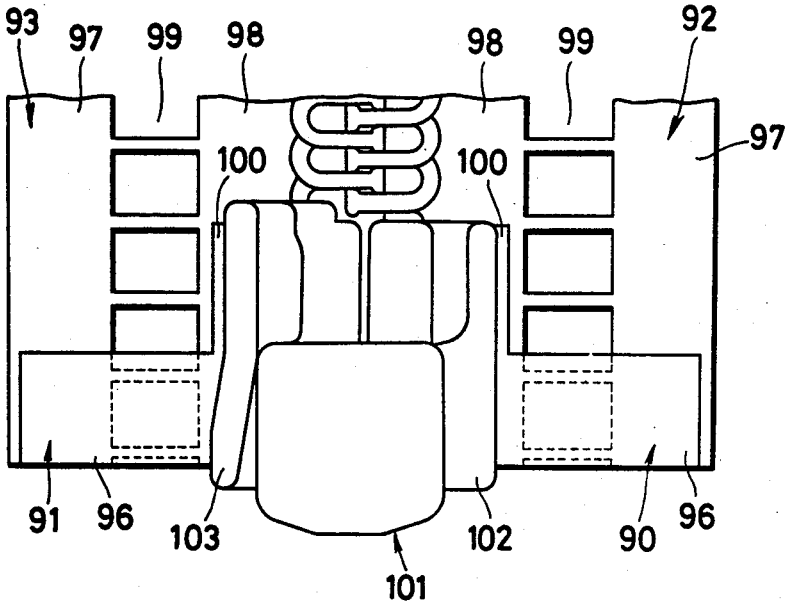
FIG. 14 is an enlarged fragmentary plan view of a lower end portion of a modified separable slide fastener.

According to still another modification shown in FIG. 14, a pair of substantially L-shaped reinforcement members or films 90,91 is bonded respectively to a pair of warp-knit stringer tapes 92,93 at and across a lower end portion thereof, each film 90,91 having a transverse portion 96 extending across a wale-free coarse region 99 between a pair of warp-knit webs 97,98 of each stringer tape 92,93. Each film 90,91 also includes a longitudinal portion 100 extending on the web 98. A separable bottom end stop 101 is mounted on the tape end portions and includes a box pin 102 and a pin 103 which are injection-molded on and along the longitudinal portions 100,100, respectively. Each of the transverse portions 96 has a width which is substantially half the length of the longitudinal portion 100 so that portions of the wale-free region 99 and the tape web 97 are exposed alongside of the longitudinal portion 100.

Figure 15:
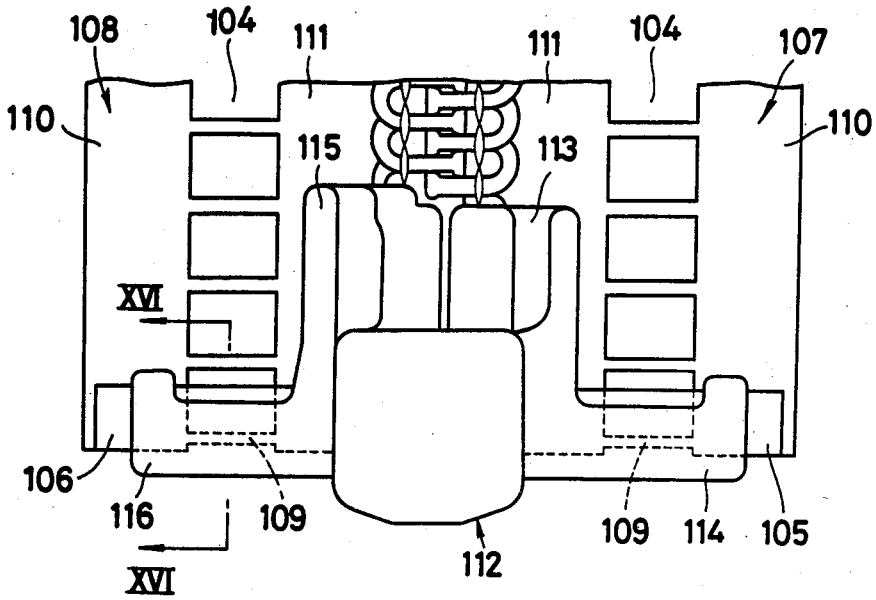
FIG. 15 is an enlarged fragmentary plan view of a lower end portion of a modified separable slide fastener.
Figure 16:
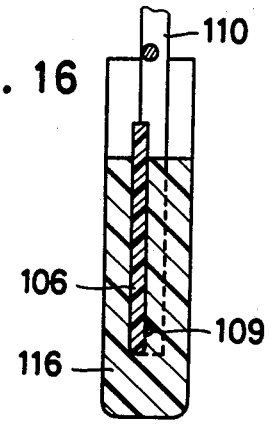
FIG. 16 is an enlarged cross-sectional view taken along line XVI—XVI of FIG. 15.

A modification illustrated in FIGS. 15 and 16 includes a pair of transverse reinforcement members or films 105,106 of a reduced width bonded respectively to a pair of warp-knit stringer tapes 107,108 at and across lower end portions thereof. Each of the reinforcement films 105,106 overlies a lowermost transverse portion 109 of a connector thread, which extends across a wale-free region 104 between a pair of webs 110 and 111 of one of the tapes 107,108. A separable bottom end stop 112 that is mounted on the stringer tapes 107,108 includes a box pin 113 having a reinforcement bar 114 integral therewith and injection-molded around an end portion of the tape 107 and a portion of the reinforcement film 105, and a pin 115 having a reinforcement bar 116 integral therewith and injection-molded around an end portion of the tape 108 and a portion of the reinforcement film 106. The reinforcement bars 114,116 extend across the wale-free regions 104,104, respectively. With the modification as illustrated in FIGS. 15 and 16, the tape ends are more stiffened and more tape surfaces are left exposed at tape end portions.

Figure 17:
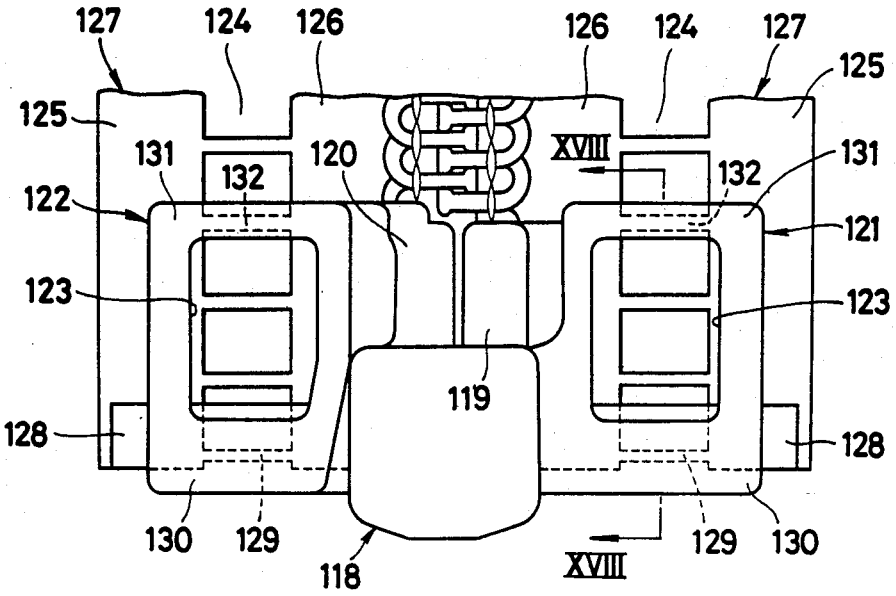
FIG. 17 is an enlarged fragmentary plan view of a lower end portion of a modified separable slide fastener.
Figure 18:
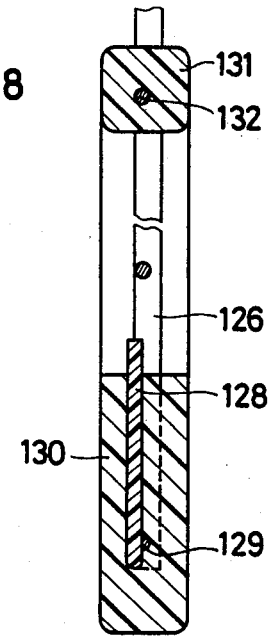
FIG. 18 is an enlarged cross-sectional view taken along line XVIII—XVIII of FIG. 17.

FIGS. 17 and 18 illustrate still another modification including a separable bottom end stop 118 having a box pin 119 and a pin 120 with which is integrally injection-molded a pair of reinforcement bodies 121,122, respectively, each in the form of a centrally opened rectangular frame having an opening 123. Each of the openings 123,123 is located at a wale-free coarse region 124 between a pair of webs 125,126 of a warp-knit stringer tape 127, the openings 123,123 being positioned adjacent to the lower end of the stringer tape 127. A transverse reinforcement film 128 is bonded to each stringer tape 127 at its end portion across the wale-free coarse region 124 and covers a lowermost transverse portion 129 of a connector thread that interconnects the webs 125,126. To prepare the assembly, after the reinforcement films 128,128 have been bonded to the stringer tapes 127,127, respectively, the reinforcement bodies 121,122 are injection-molded on the stringer tapes 127,127. Each of the reinforcement bodies 121,122 includes a lower transverse portion 130 wrapping the lowermost transverse thread portion 129 and a portion of the reinforcement film 128, and an upper transverse portion 131 wrapping another transverse thread portion 132 extending across the wale-free region 124.

Figure 19:
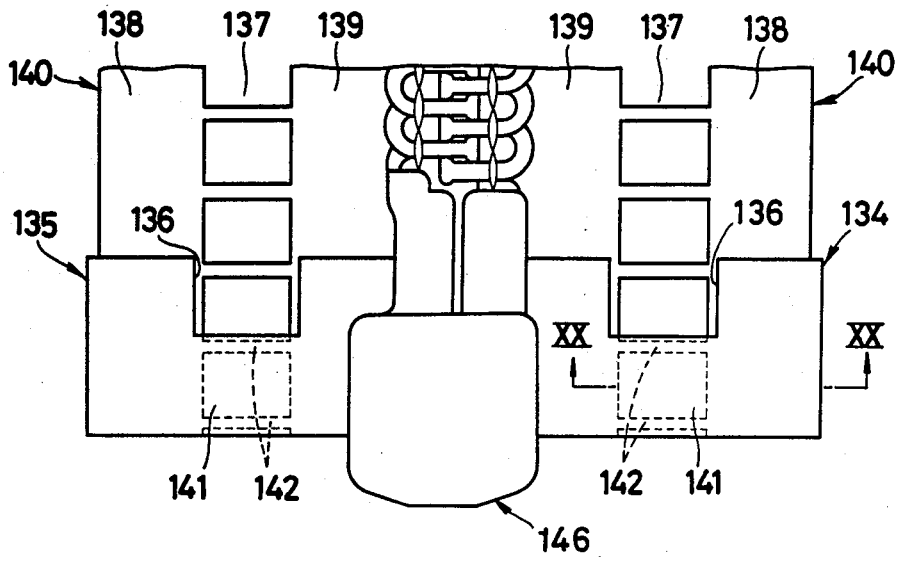
FIG. 19 is an enlarged fragmentary plan view of a lower end portion of a modified separable slide fastener.
Figure 20:
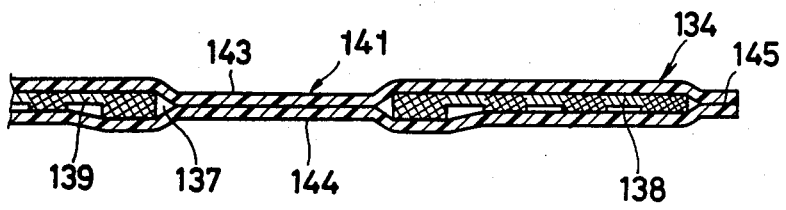
FIG. 20 is an enlarged cross-sectional view taken along line XX—XX of FIG. 19.

According to still another modification shown in FIGS. 19 and 20, a pair of reinforcement films 134,135 is bonded to a pair of stringer tapes 140,140, respectively, at lower end portions thereof. Each of the reinforcement films 134,135 has a recess 136 which registers with a wale-free coarse region 137 between a pair of webs 138,139 of one of the stringer tapes 140. Each of the reinforcement films 134,135 includes a central bottom portion 141 located adjacent to the recess 136 and covering two transverse portions 142,142 of a connector thread spanning across the wale-free coarse region 137. As best shown in FIG. 20, the reinforcement film 134 comprises a pair of layers 143,144 sandwiching the stringer tape 140 therebetween and bonded together at an outer edge 145 and at the central bottom portion 141 in the wale-free coarse region 137. A separable bottom end stop 146 is injection-molded on the stringer tapes 140,140 after the reinforcement films 134,135 have been bonded to the stringer tapes 140,140.

Figure 21:
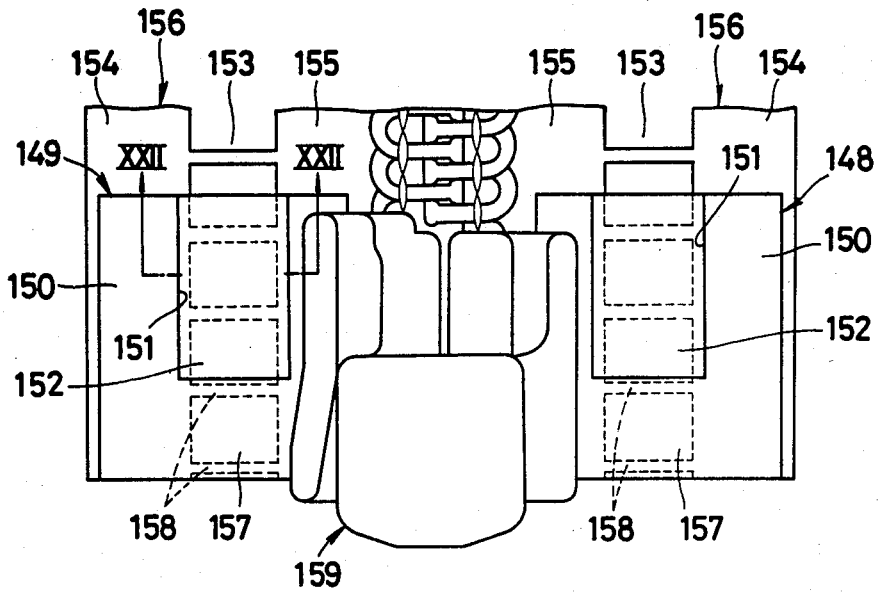
FIG. 21 is an enlarged fragmentary plan view of a lower end portion of a modified separable slide fastener.
Figure 22:
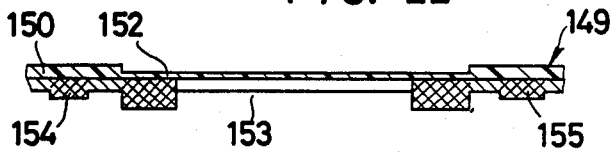
FIG. 22 is an enlarged cross-sectional view taken along line XXII—XXII of FIG. 21.

FIGS. 21 and 22 illustrate still another modification in which a pair of reinforcement films 148,149 is bonded respectively to a pair of stringer tapes 156,156 and each comprises a U-shaped thick layer 150 having a recess 151 and a thin layer 152 disposed in the recess 151 in registry with a wale-free coarse region 153 between a pair of webs 154,155 of the stringer tape 156. Each of the reinforcement films 148,149 also includes a central bottom portion 157 adjacent to the recess 151, covering two transverse portions 158,158 of a connector thread extending across the wale-free region 153. Bonding of the reinforcement films 148,149 to the tapes 156,156 is followed by injection-molding of a separable bottom end stop 159 on the tapes 156,156. The thin layer 152 has a thickness such that it will be penetratable by knitting needles as described later on.

Figure 23:
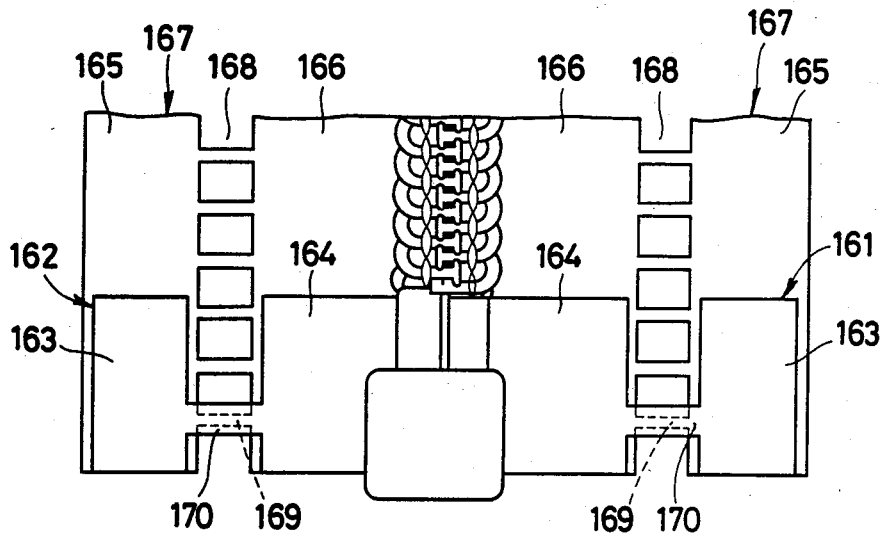
FIG. 23 an enlarged fragmentary plan view of a lower end portion of a modified separable slide fastener.

According to a modification shown in FIG. 23 each of, a pair of reinforcement films 161,162 includes a pair of laterally spaced portions 163,164 bonded respectively to a pair of webs 165,166 of a warp-knit stringer tape 167. The stringer tape 167 has a wale-free coarse region 168 located between the webs 165,166 and has a lowermost transverse portion 169 of a connector thread interconnecting the webs 165,166 across the wale-free region 168. Each of the reinforcement films 161,162 also includes a bridge portion 170 interconnecting the film portions 163,164 at a position spaced from the lower end of the stringer tape 167, the bridge portion 170 covering the lowermost transverse thread portion 169.

Figure 24:
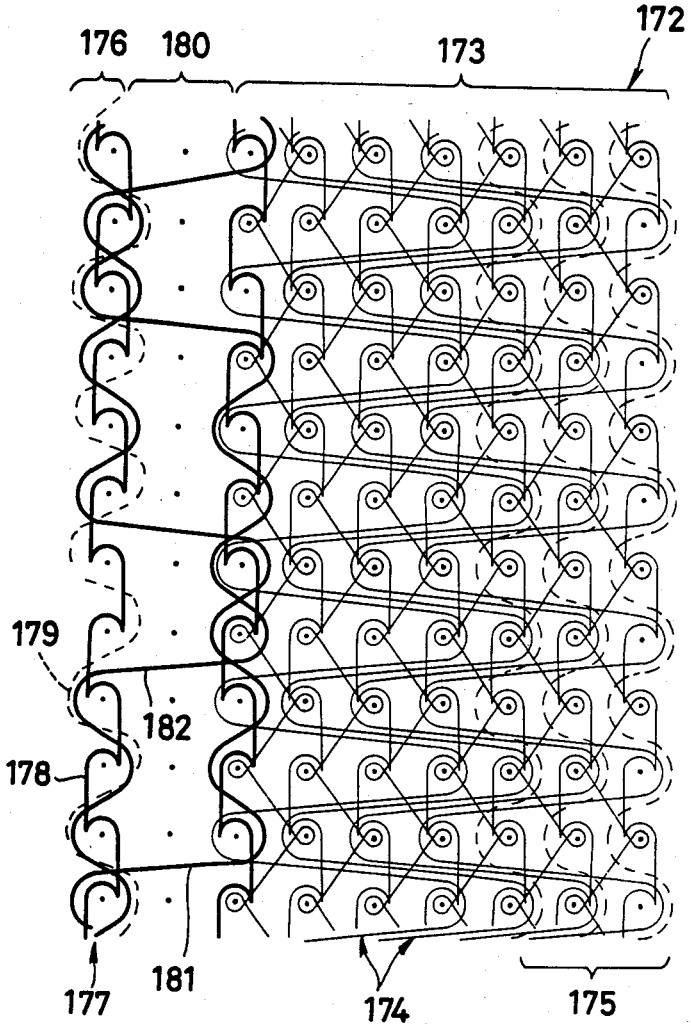
FIG. 24 is a point diagram showing lapping movements for a modified stringer tape.

A modified warp-knit stringer tape 172 shown in FIG. 24 comprises a web 173 having a plurality of wales 174 juxtaposed thereacross, three of which constitute an edge portion 175 for supporting a row of coupling elements (not shown). The stringer tape 172 also includes another web 176 composed of a single wale 177 which comprises chain stitches 178 knit in a pattern of 1-1/0-0 and reinforced by an inlaid warp thread 179, the web 176 being transversely spaced from the web 173 with a wale-free coarse region 180 therebetween which is devoid of one wale and across which extends a pair of connector threads 181,182 laid in patterns of 0-0/1-1/0-0/1-1/0-0/3-3/2-2/3-3/2-2/3-3 and 3-3/2-2/3-3/0-0/1-1/0-0/1-1/0-0/3-3/2-2, respectively, and which interconnects the wale 177 and an innermost one of the wales 174 which confronts the wale 177.

Figure 25:
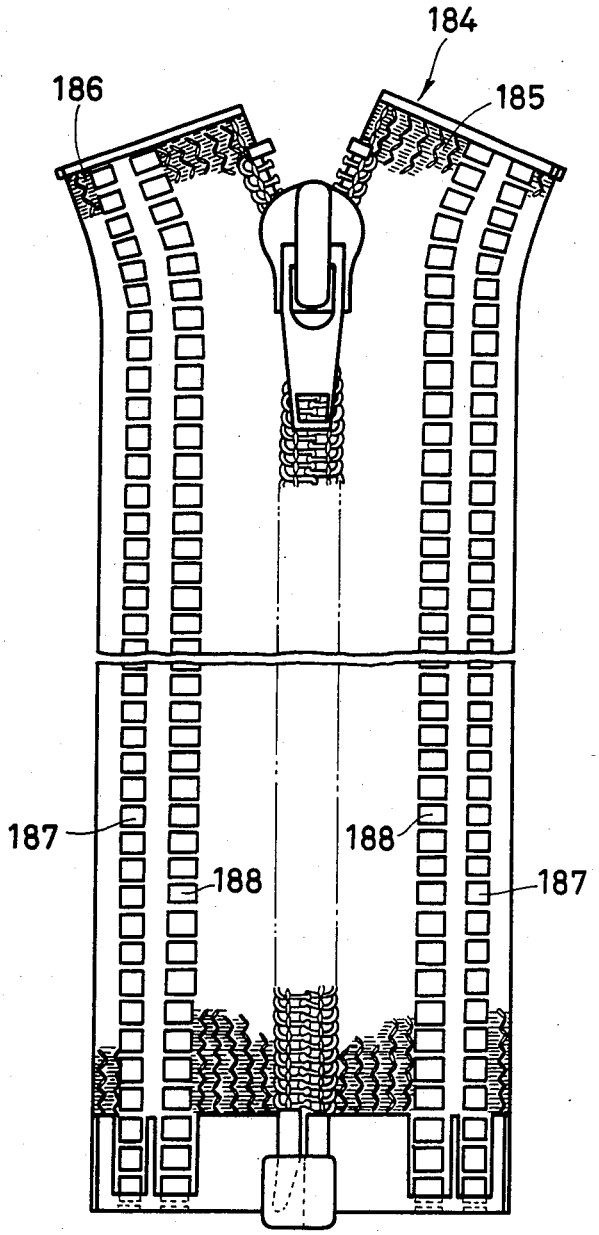
FIG. 25 is a fragmentary plan view of a further separable slide fastener.

FIG. 25 illustrates a separable slide fastener 184 of the present invention. The slide fastener 184 comprises a pair of warp-knit stringer tapes 185,186 each having a pair of longitudinal wale-free coarse regions 187,188 which are selectively utilized for attachment to a garment.

Figure 26:
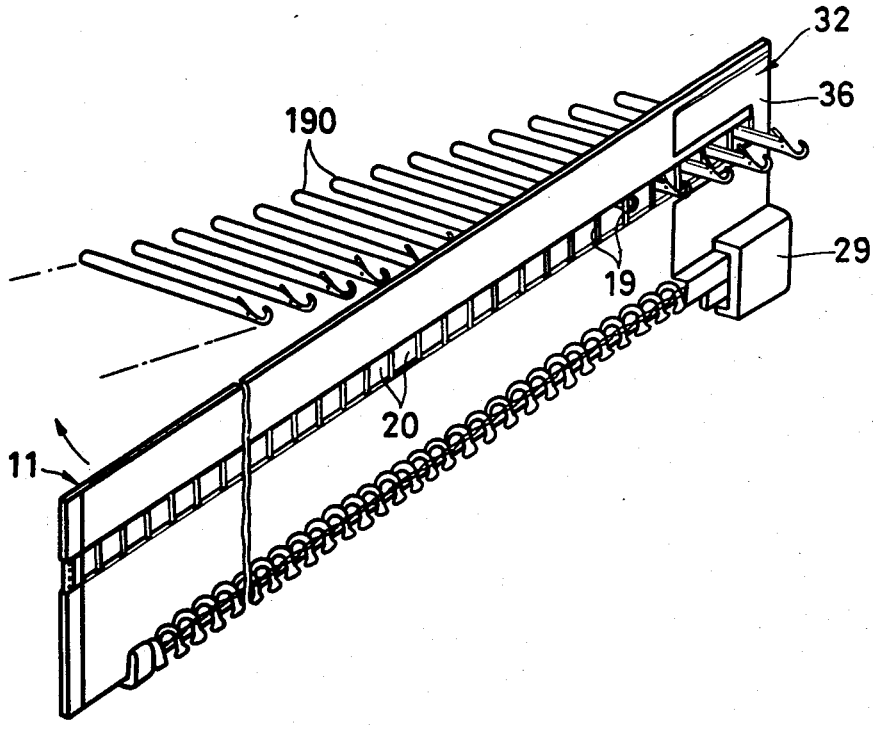
FIG. 26 is an enlarged fragmentary perspective view illustrative of the way in which one of the stringers of FIG. 1 is put on a row of knitting needles.
Figure 27:
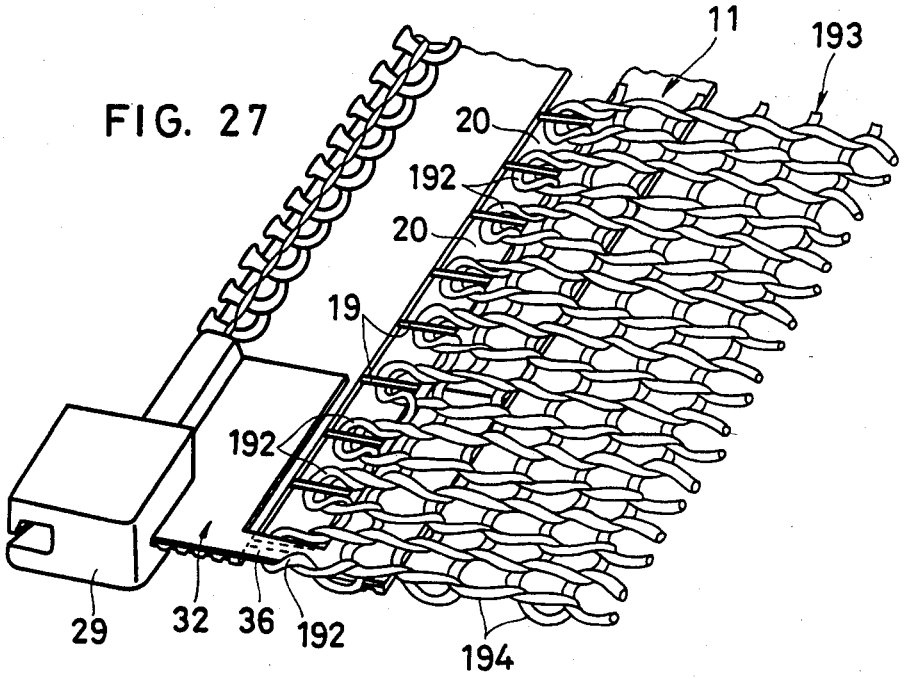
FIG. 27 is an enlarged fragmentary perspective view of the stringer of FIG. 1 which is knit into a knit fabric on the needles shown in FIG. 26.

FIGS. 26 and 27 are illustrative of a manner in which the separable slide fastener 10 shown in FIGS. 1 through 6 is knit into a knit fabric. First, the slide fastener 10 is uncoupled or separated, and one of the stringers 11 is put on a knitting machine so that a series of knitting needles 190 thereof are inserted into the openings 20 in the stringer tape 11. At this time, the endmost one of the openings 20 which is adjacent to the reinforcement film portion 36 (FIG. 3) should receive one of the knitting needles 190. When the stringer is thus mounted on the knitting needles 190, the stringer tape 11 is longitudinally tensioned so that the film portion 36 is first engaged by the knitting needle 190, and then the stringer is successively placed on the knitting needles 190. The film portion 36 therefore serves as a positioning guide. The knitting needles 190 may occupy all of the openings 20 or may skip some of the openings 20 depending on the gauge of the knitting machine used. After the stringer is readied on the knitting machine for knitting operation, the knitting machine is operated in the usual manner to knit a row of needle loops 192 (FIG. 27), or a first course, that are looped with the transverse thread portions 19. The knitting machine is continuously operated to form a knit fabric 193 including a plurality of successive courses 194. The slide fastener stringer is thus knit into the knit fabric 193.

Figure 28:
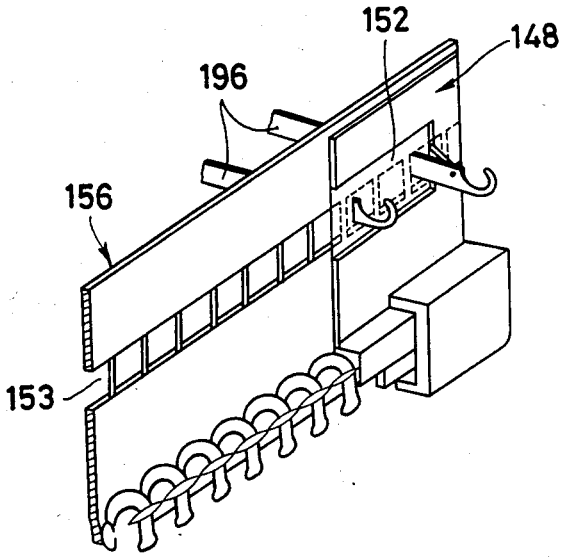
FIG. 28 is an enlarged fragmentary perspective view illustrative of the way in which one of the stringers of FIG. 21 is put on knitting needles.

The stringer tape 156 as illustrated in FIGS. 21 and 22 can be mounted on a knitting machine by first thrusting or penetrating a pair of knitting needles 196,196 into the thin layer 152 of the reinforcement film 148 as shown in FIG. 28.

Figure 29:
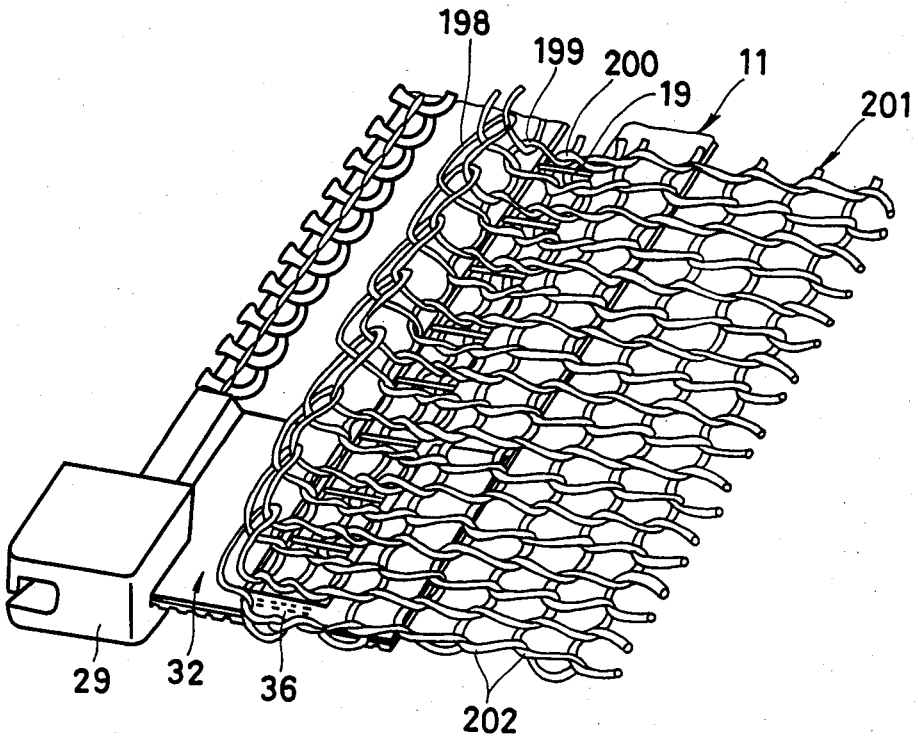
FIG. 29 is an enlarged fragmentary perspective view of a slide fastener stringer which is differently knit into a knit fabric.

According to a modification shown in FIG. 29, a selvage 198 and a row of needle loops 199 constituting a first course are first knitted on a knitting machine, and then the stringer tape 11 is put on the knitting machine. Knitting is started again to form a next row of needle loops 200 constituting a second course and looped around the transverse thread portions 19. Continuous knitting operation forms a knit fabric 201 having successive courses 202. The selvage 198 overlaps and hence conceals a portion of the stringer tape 11 to make a finished knit article look sightly and attractive.

Figure 30:
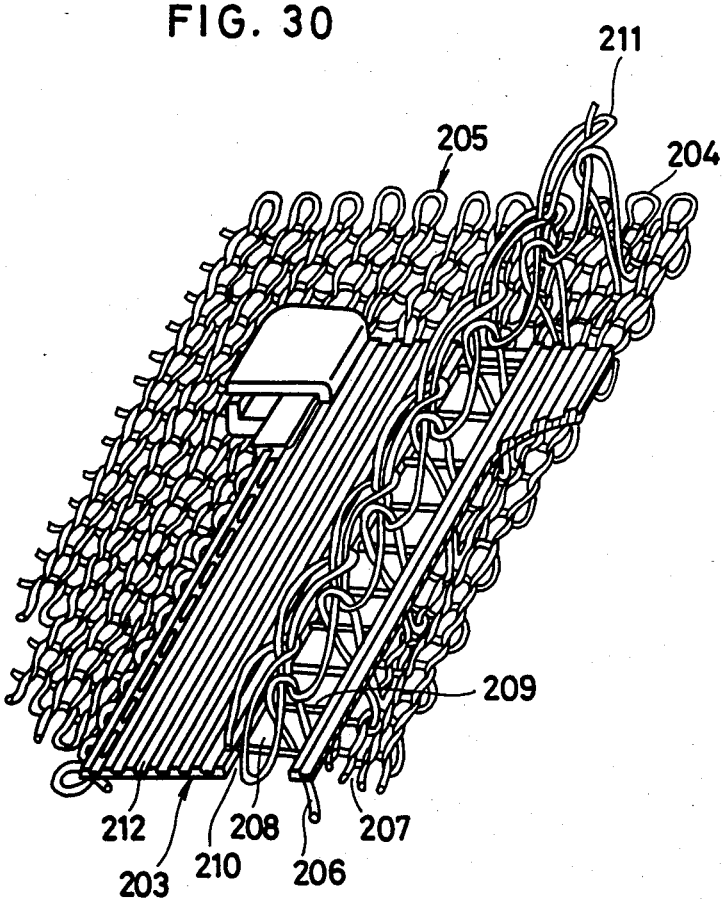
FIG. 30 is an enlarged fragmentary perspective view of a slide fastener stringer attached to a knit fabric.

FIG. 30 shows a slide fastener stringer 203 attached along a marginal edge 204 of a prefabricated knit garment 205. The stringer 203 is fastened to the knit garment 205 by a first row of loops 206 extending along a wale 207 through the knit garment 205 and a row of openings 208 defined by transverse thread portions 209 extending across a wale-free region 210 in a stringer tape 212 of the stringer 203. A linking thread 211 in the form of a row of loops or chain stitches is interlooped with the first row of loops 206 projecting through the openings 208 to connect the stringer 203 and the knit garment 205 together. Such linking operation can be carried out by an ordinary knitting machine or a linking machine or looper.

Figure 31:
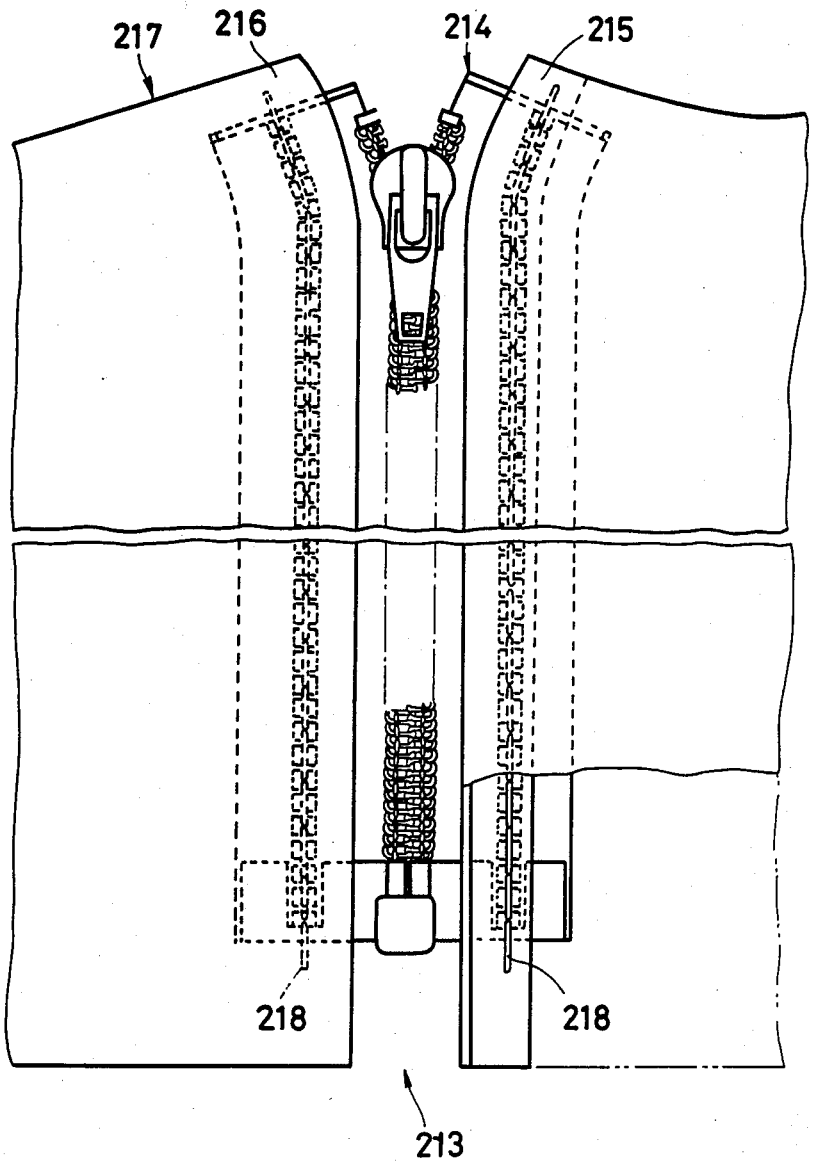
FIG. 31 is a fragmentary plan view of a knit article having a separable slide fastener attached to a knit garment.

FIG. 31 illustrates a knit article 213 including a separable slide fastener 214 identical to the slide fastener 10 as shown in FIG. 1 and a knit garment 217 having a pair of opposed edges 215,216 on which the separable slide fastener 214 is mounted. The slide fastener 214 is attached to the fabric edges 215,216 by stitches 218,218 which are interlooped with non-illustrated loops in the same pattern as shown in FIG. 30.

Although various minor modifications might be suggested by those versed in the art, it should be understood that we wish to embody within the scope of the patent warranted hereon, all such embodiments as reasonably and properly come within the scope of our contribution to the art.

What is claimed is:

1. A method of attaching a slide fastener stringer to a knit fabric, comprising the steps of:

(a) providing a slide fastener stringer having two tape webs spaced from each other and interconnected by a plurality of longitudinally spaced transverse thread portions;

(b) looping said transverse thread portions with a row of loops which constitute a course of a knit fabric; and (c) thereafter, knitting said knit fabric so as to form successive courses.

2. A method according to claim 1, said row of loops defining a selvage of said knit fabric.

3. A method of attaching a slide fastener stringer to a knit fabric on a knitting machine, comprising the steps of:

(a) providing a slide fastener stringer having a series of longitudinally arranged openings therein;

(b) inserting a series of knitting needles of the knitting machine into said openings in the stringer; and (c) thereafter, knitting a fabric on said knitting needles so as to form successive courses.

4. A method according to claim 3, including the step of forming at least one course on said knitting needles before said inserting step (b).

5. A method of attaching a slide fastener stringer to a knit fabric, comprising the steps of:

(a) providing a slide fastener stringer having a series of longitudinally arranged openings therein;

(b) introducing into said openings a row of loops projecting from and extending along a wale of a knit fabric; and (c) thereafter, interlooping a linking thread with said row of loops projecting through said openings.

6. A method according to claim 1, said linking thread constituting a row of chain stitches.

7. A method of attaching a slide fastener stringer to a knit fabric, comprising the steps of:

(a) providing a slide fastener stringer having a series of longitudinally arranged openings therein, a separable bottom end stop member, and a reinforced end portion adjacent to said separable bottom end stop member;

(b) inserting a series of knitting needles of a knitting machine successively into said openings in said stringer while the stringer is being tensioned with one of the knitting needles being held against said reinforced end portion; and (c) thereafter, knitting a fabric on said knitting needles so as to form successive courses.

* * * * *